US008631997B2

(12) United States Patent
Millet et al.

(10) Patent No.: US 8,631,997 B2
(45) Date of Patent: Jan. 21, 2014

(54) TACO HOLDER

(76) Inventors: David L. Millet, Salt Lake City, UT (US); Gary Millet, Salt Lake City, UT (US)

( * ) Notice: Subject to any disclaimer, the term of this patent is extended or adjusted under 35 U.S.C. 154(b) by 350 days.

(21) Appl. No.: 12/899,286

(22) Filed: Oct. 6, 2010

(65) Prior Publication Data

US 2012/0085769 A1 Apr. 12, 2012

(51) Int. Cl.
*B65D 5/36* (2006.01)

(52) U.S. Cl.
USPC ..... 229/114; 229/117.01; 229/405; 229/902; 229/938

(58) Field of Classification Search
USPC ..... 229/112, 113, 114, 117.01, 405, 902, 229/906, 938
See application file for complete search history.

(56) References Cited

U.S. PATENT DOCUMENTS

| | | | | | |
|---|---|---|---|---|---|
| 203,899 | A | * | 5/1878 | Dunn | 229/114 |
| 2,603,409 | A | * | 7/1952 | Crary | 229/117.01 |
| 2,875,943 | A | * | 3/1959 | Cooper | 229/114 |
| 2,893,295 | A | * | 7/1959 | Magill | 229/117.01 |
| 2,896,839 | A | * | 7/1959 | Barnes et al. | 229/117.01 |
| 3,366,308 | A | * | 1/1968 | Phillips, Jr. | 229/117.01 |
| 3,446,416 | A | | 5/1969 | Epstein | |
| 3,743,169 | A | * | 7/1973 | Person | 229/114 |
| 4,267,955 | A | | 5/1981 | Struble | |
| 4,402,452 | A | * | 9/1983 | Kupersmit | 229/117.01 |
| 4,657,176 | A | * | 4/1987 | Matsubara | 229/117.01 |
| 4,929,458 | A | | 5/1990 | Smietana | |
| 5,005,704 | A | | 4/1991 | Martin | |
| 5,065,870 | A | | 11/1991 | Conder, Jr. | |
| 5,421,508 | A | | 6/1995 | Beales | |
| 5,492,269 | A | * | 2/1996 | Sung | 229/405 |
| 5,503,477 | A | | 4/1996 | Schlough | |
| 5,518,169 | A | | 5/1996 | Beales | |
| 5,921,466 | A | | 7/1999 | Speese et al. | |
| D478,283 | S | | 8/2003 | Shimakawa | |
| D558,951 | S | | 1/2008 | Proffitt | |
| D640,503 | S | | 6/2011 | Millet | |

OTHER PUBLICATIONS

U.S. Appl. No. 29/376,408, Mar. 11, 2011, Notice of Allowance.

* cited by examiner

*Primary Examiner* — Gary Elkins
(74) *Attorney, Agent, or Firm* — Workman Nydegger

(57) ABSTRACT

A taco holder including a rigid, foldable template that retains a crease when folded, which has portions and fold lines configured so that the taco holder is easily configurable between an open configuration and a folded configuration. The open configuration is defined by the fold lines being substantially unfolded such that front edges of the portions of the taco holder define an opening configured to receive a taco or other folded sandwich food. The folded configuration is defined by the fold lines being substantially folded such that the foldable food container is substantially flat.

8 Claims, 11 Drawing Sheets

TACO HOLDER

CROSS-REFERENCE TO RELATED APPLICATIONS

Not applicable.

BACKGROUND OF THE INVENTION

1. The Field of the Invention

This disclosure describes taco holders. Specifically, this disclosure concerns foldable taco holders and taco holders with tailored shapes.

2. The Relevant Technology

Those familiar with the food item known as a taco know that the taco is a hard or soft outer shell in which fillings—such as meat, cheese, and vegetables—are placed. The taco is then consumed by holding the outer shell and consuming the shell and its contents from one side to the other. One problem encountered while consuming tacos is that a person consuming a taco may hold the taco in such a way that the fillings tend to fall out of the outer shell of the taco. For example, a person may hold a taco vertically to consume one end of the taco while fillings from the other end of the taco fall out the bottom.

In the United States, many tacos are consumed from fast-food-type establishments, where the purpose is to serve as many tacos as fast as possible. Thus, fast-food vendors do not have the time to provide possible time-consuming solutions to the problem of fillings falling out of tacos. Furthermore, taco vendors, such as those that sell tacos from food carts, may not have adequate space to store voluminous extra materials that might assist consumers in the retention of their taco fillings.

BRIEF SUMMARY OF THE INVENTION

Taco holders are described herein that provide a simple, fast, space-saving solution to retaining fillings inside of taco shells. In one embodiment a taco holder includes a rigid, foldable template that retains a crease when folded, which has an upper portion, a lower portion, a first side portion, a second side portion, and a rear portion. The upper and lower portions are defined by front edges, rear edges, first side edges, and second side edges. The front edges may be substantially the same length as the rear edges, and the first side edges and the second side edges may be substantially the same length. The upper and lower portions are coupled to the first side portion and second side portions along the first side edges and the second side edges respectively, and the upper and lower portions are coupled to the rear portion along the rear edges. The first and second side portions are defined by front edges, rear edges, first rear fold lines, second rear fold lines, and bifurcating fold lines. The front edges of the first and second side portions may be longer than the rear edges, and the first and second side portions are coupled to the rear portion along the rear edges. The bifurcating fold lines extend from the front edges toward the rear edges of the first and second side portions, and the bifurcating fold lines partially bifurcate the first and second side portions into upper and lower sections. The first and second rear fold lines of the first and second side portions extend from the rear edges of the side portions to the bifurcating fold lines. An upper fold line extends between the bifurcating fold lines such that the upper fold line extends across the upper portion.

With this, or similar configuration, the taco holder is easily configurable between an open configuration and a folded configuration. The open configuration is defined by the rear fold lines, the bifurcating fold lines, and the upper fold line being substantially unfolded such that the front edges of the upper, lower, and side portions define an opening configured to receive a taco or other folded sandwich food. The folded configuration is defined by the rear fold lines, the bifurcating fold lines, and the upper fold line being substantially folded such that the rear portion at least partially folds over the upper portion so that the foldable food container is substantially flat.

These and other embodiments and features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which:

FIGS. 6A-5I illustrates one method of constructing one embodiment of a taco holder from a taco holder template 600;

DETAILED DESCRIPTION OF THE PREFERRED EMBODIMENTS

Exemplary embodiments of a taco holder will now be described with reference to the Figures, the illustrated and described embodiments are exemplary only, and one of skill in the art will recognize many variations of the described embodiments within the scope of the claims.

Figure 1:
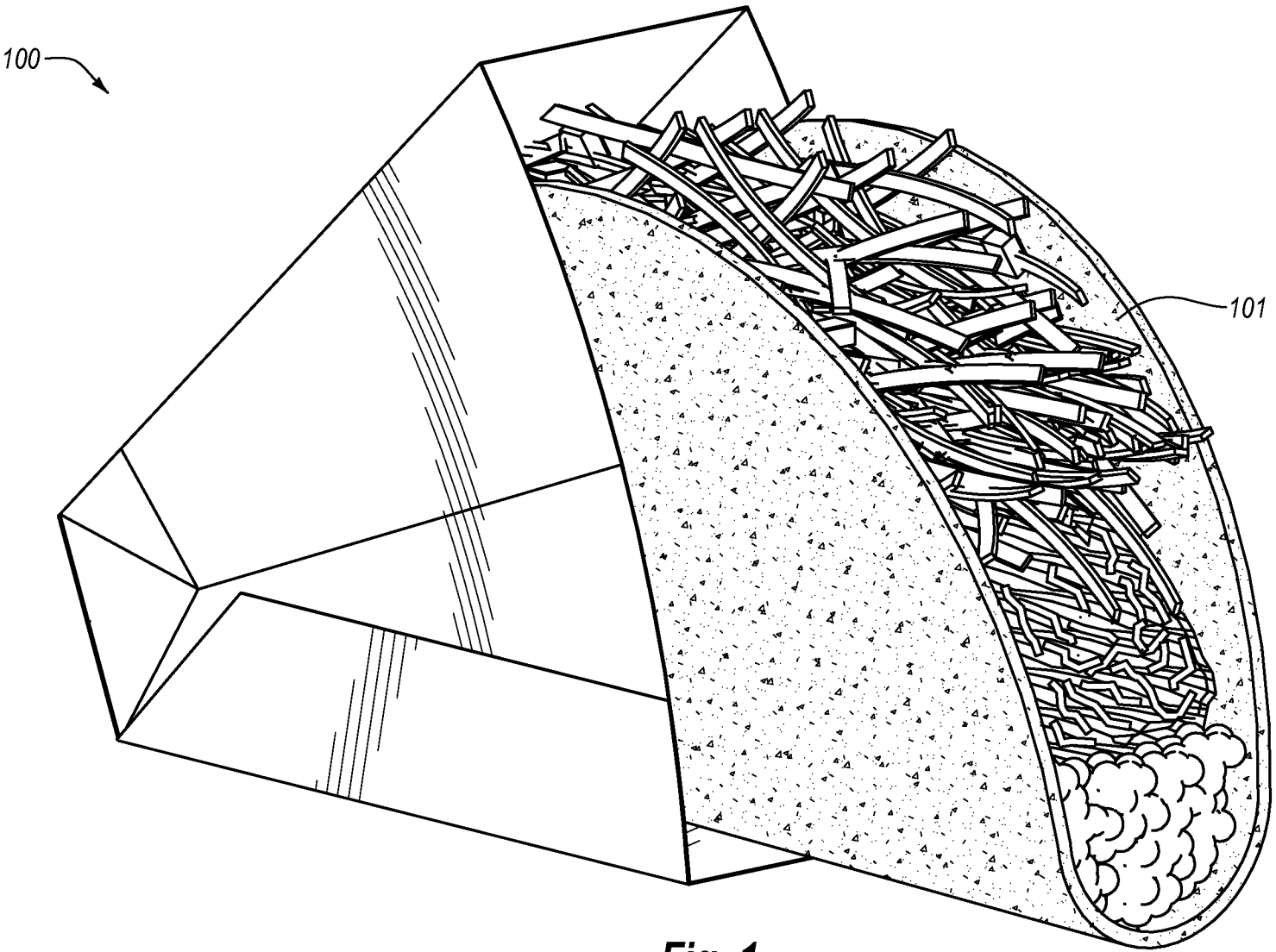
FIG. 1 illustrates one embodiment of a foldable taco holder 100 in which a taco 101 is inserted, which shows an exemplary use of a taco holder.

Referring first to FIG. 1, FIG. 1 shows one embodiment of a taco holder 100 in use with a taco 101 inserted therein. Further description of the taco holder 100 is provided in FIG. 2 wherein the taco 101 has been removed.

Figure 2:
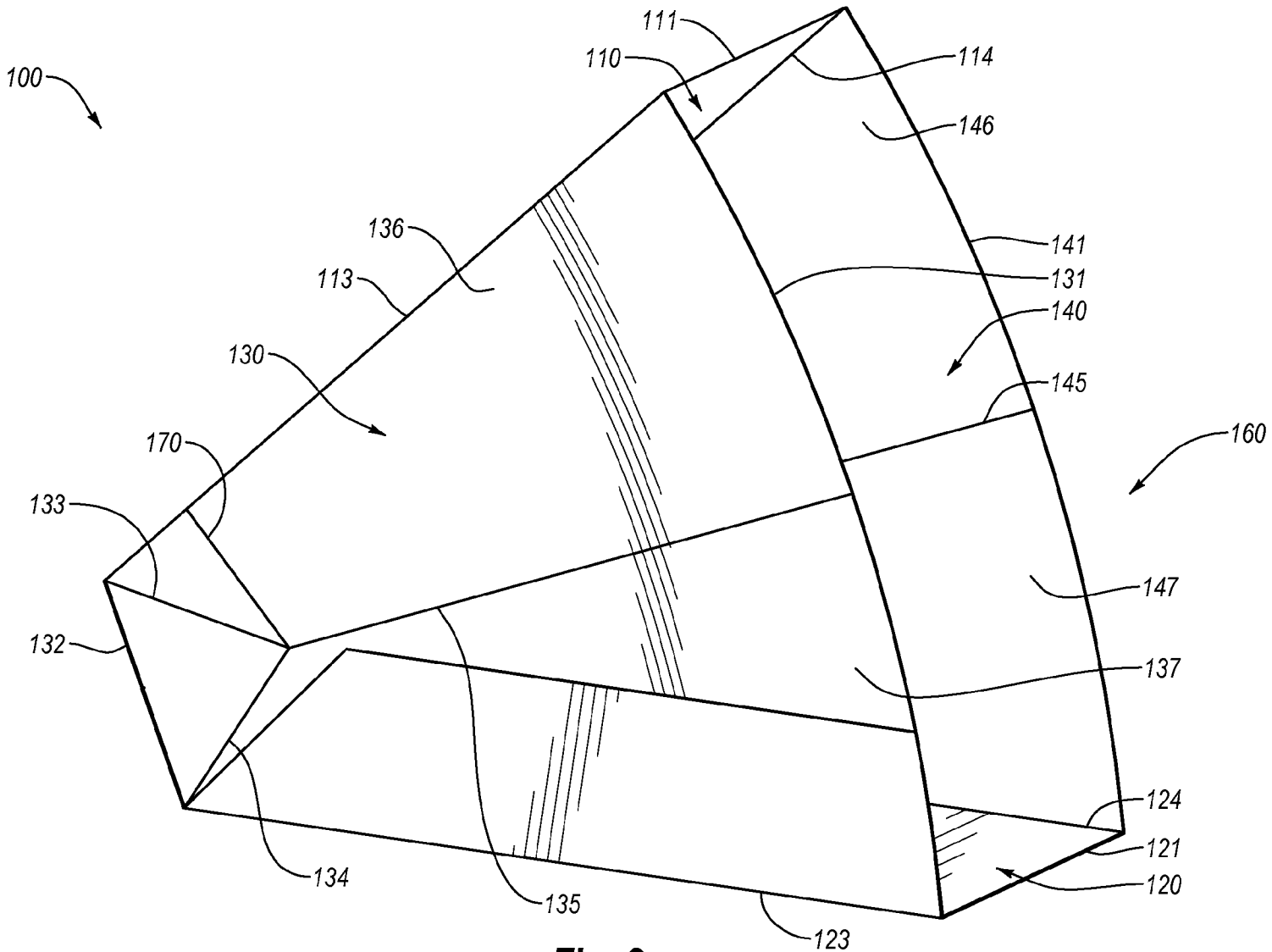
FIG. 2 illustrates the embodiment of the foldable taco holder 100 of FIG. 1, which is illustrated without anything inserted therein so that an upper portion 110, lower portion 120, first side portion 130, second side portion 140, rear portion 150, and opening 160 of the foldable taco holder 100 may be seen.

FIG. 2 shows taco holder 100 in an open configuration. Upper portion 110 includes a front edge 111, a rear edge 112 (shown in FIG. 3), a first side edge 113, and a second side edge 114. Upper portion 110 is coupled to first side portion 130 along first side edge 113 of the upper portion 110, and upper portion 110 is coupled to second side portion 140 along second side edge 114 of the upper portion 140. Lower portion 120 includes a front edge 121, a rear edge 122 (shown in FIG. 4), a first side edge 123, and a second side edge 124. Lower portion 120 is coupled to first side portion 130 along first side edge 123 of lower portion 120, and lower portion 120 is coupled to second side portion 140 along second side edge 124 of lower portion 120.

First side portion 130 includes a front edge 131, a rear edge 132, a first rear fold line 133, a second rear fold line 134, and a bifurcating fold line 135. First side portion 130 is coupled to rear portion 150 along rear edge 132 of first side portion 130. Bifurcating fold line 135 partially bifurcates first side portion 130 into an upper section 136 and a lower sections 137. Likewise, second side portion 140 includes a front edge 141, a rear edge 142 (shown in FIG. 4), and a bifurcating fold line 145, which partially bifurcates second side portion 140 into an upper section 146 and a lower section 147. Second side portion 140 also includes first and second rear fold lines in a similar configuration to those of first side portion 130.

Figure 3:
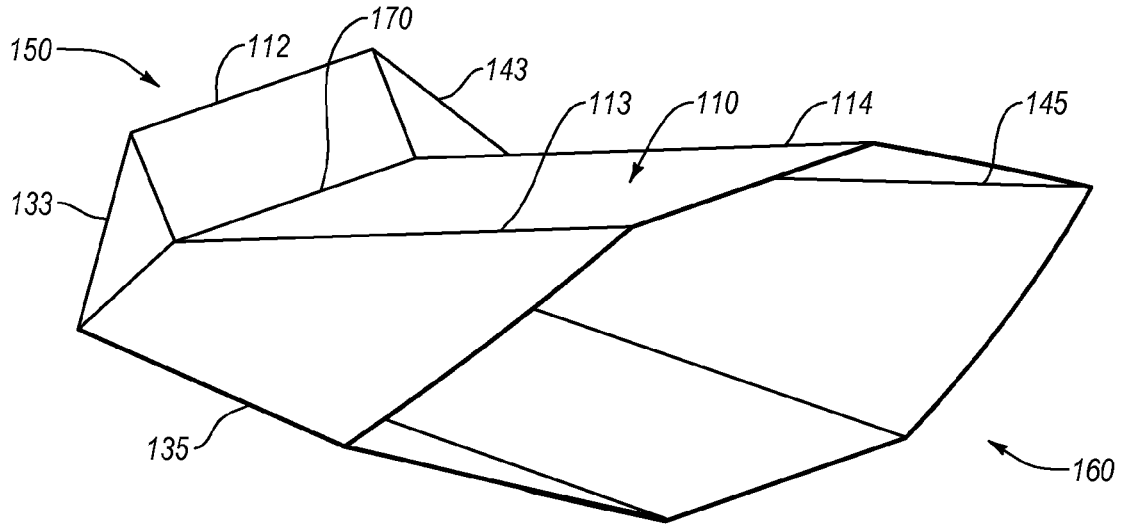
FIG. 3 illustrates the embodiment of the foldable taco holder 100 of FIG. 1 in an intermediately folded configuration, wherein the taco holder 100 is substantially flattened.

An upper fold line 170 extends between bifurcating fold line 135 and bifurcating fold line 145 such that upper fold line 170 extends across upper portion 100 (as shown in FIG. 3).

The several fold lines of taco holder 100 permit selective configuration of taco holder 100 between an open configuration and a folded configuration. As stated FIG. 2 shows taco holder 100 in an open configuration, which, as shown, is characterized in part by first rear fold line 133, second rear fold line 134, and bifurcating fold line 135 of first side portion 130; by first and second rear fold lines and bifurcating fold line 145 of second side portion 140; and by upper fold line 170 being unfolded. Thus, in the open configuration, front edge 111, front edge 121, front edge 131, and front edge 141 define opening 160 in which a taco or other folded sandwich food may be placed, such as taco 101 shown in FIG. 1. Alternative configurations for taco holder 100 will now be described with reference to FIGS. 3 and 4.

Figure 4:
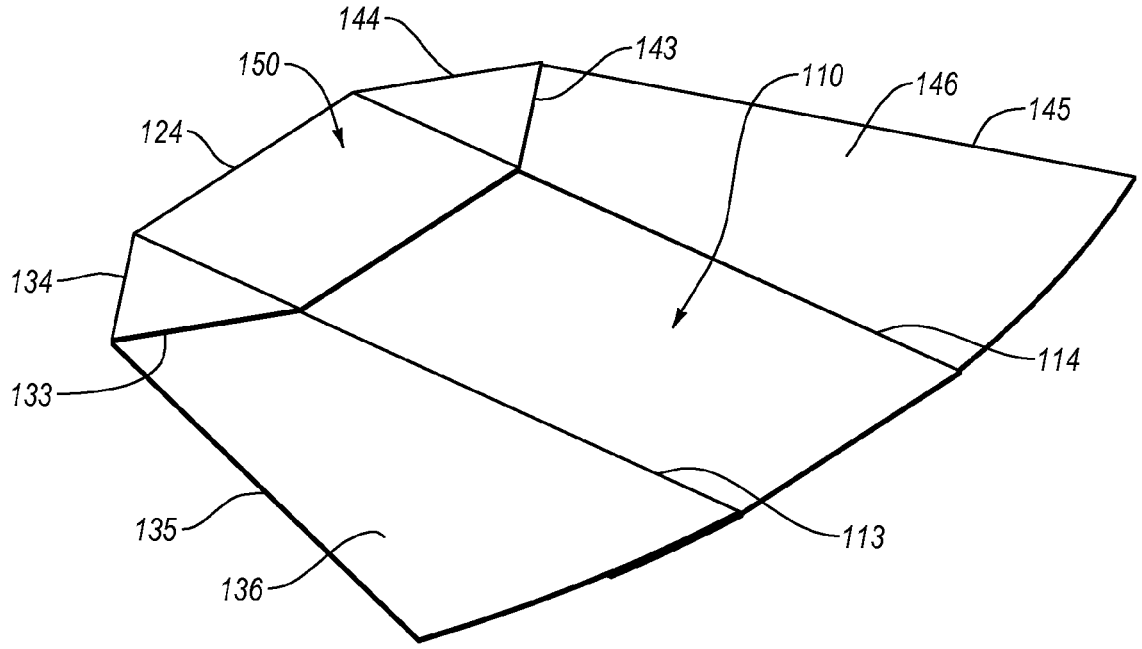
FIG. 4 illustrates the embodiment of the foldable taco holder 100 of FIG. 1 in a completely flat configuration.

FIGS. 3 and 4 show taco holder 100 in a folded configuration in which taco holder 100 is substantially flat. The view of FIG. 3 shows that upper portion 110 is coupled to rear portion 150 along rear edge 112 of upper portion 110, and the view of FIG. 4 shows that lower portion 120 is coupled to rear portion 150 along rear edge 122 of lower portion 120.

As shown in FIGS. 3 and 4, the folded configuration is characterized in part by first rear fold line 133, second rear fold line 134, and bifurcating fold line 135 of first side portion 130; by first and second rear fold lines and bifurcating fold line 145 of second side portion 145; and by upper fold line 170 being folded. FIG. 4 shows that in the folded configuration, rear portion 150 may partially fold over upper portion 110.

Figure 5:
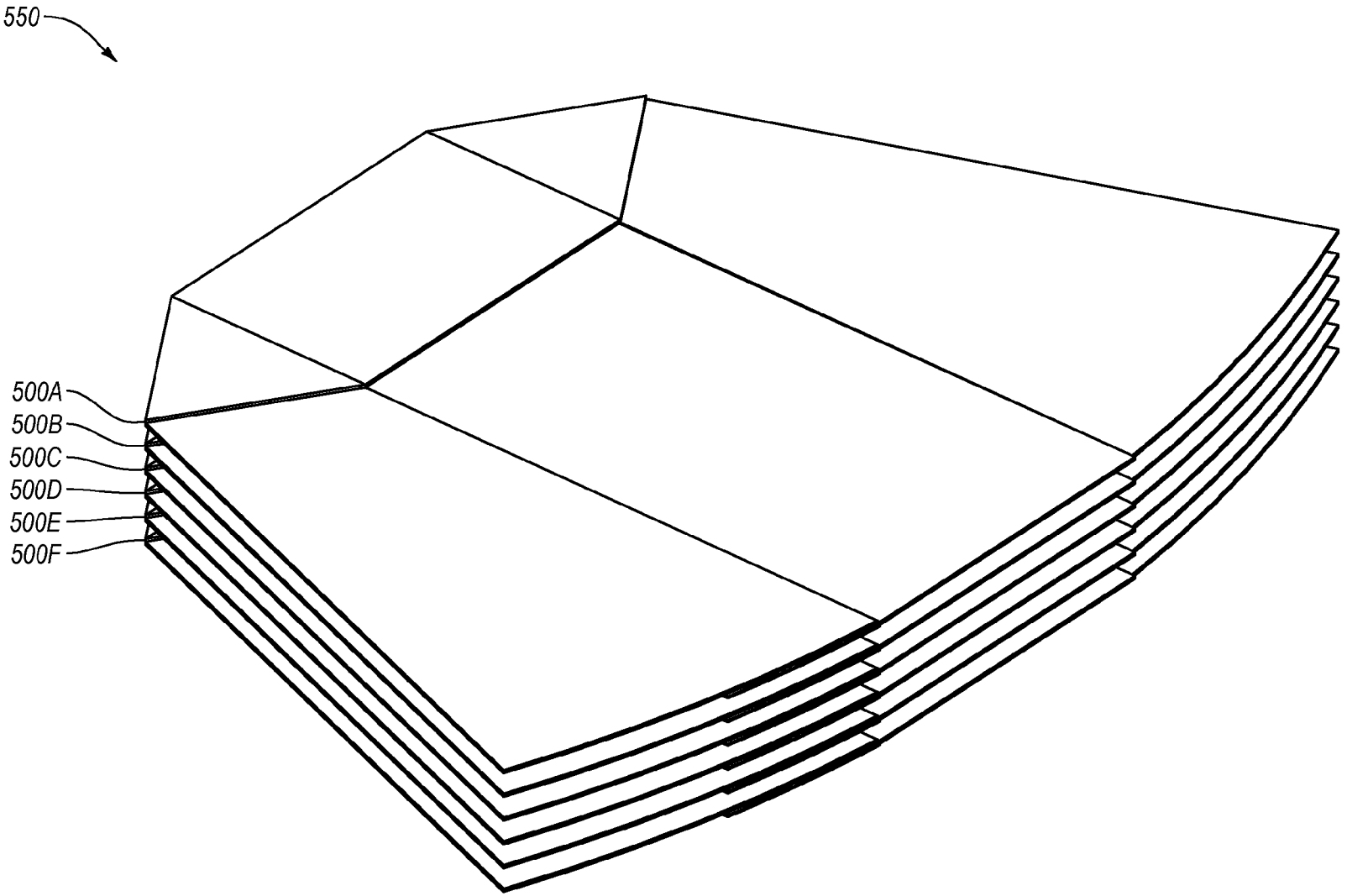
FIG. 5 illustrates a stack 550 of folded taco holders 500A-500F, which have been folded.

The folded configuration of taco holder 100 may be advantageous for shipping and storing multiple taco holders. For example, FIG. 5 shows a stack 550 of taco holders 500A-F in a folded configuration. As shown, in the folded configuration, taco holders 500A-F may be flattened and stacked so that little space is required to ship and store the taco holders. If taco holders are shipped and stored in a folded configuration, a user may simply unfold, or pop open, a taco holder by straightforward manipulation prior to using the taco holder.

Figure 6A:
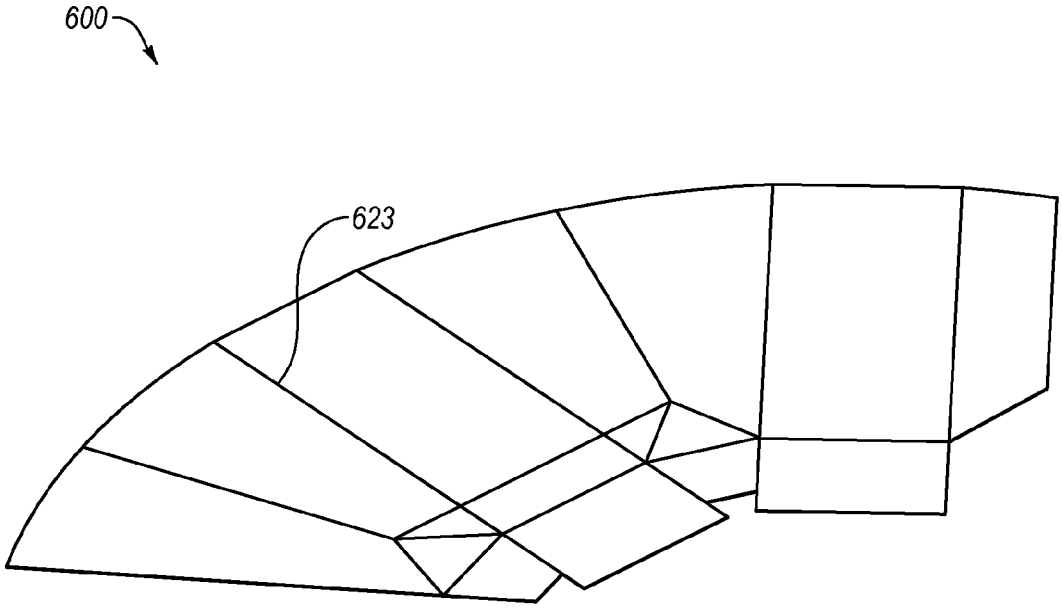

A method of making one embodiment of a taco holder will now be described with reference to FIG. 6A-I. As shown in FIG. 6A, a taco holder template 600 is provided having various portions and fold lines described hereinbelow. Taco holder template 600 may be of any foldable material such as paper, cardstock, cardboard, or other paper-based material.

Figure 6B:
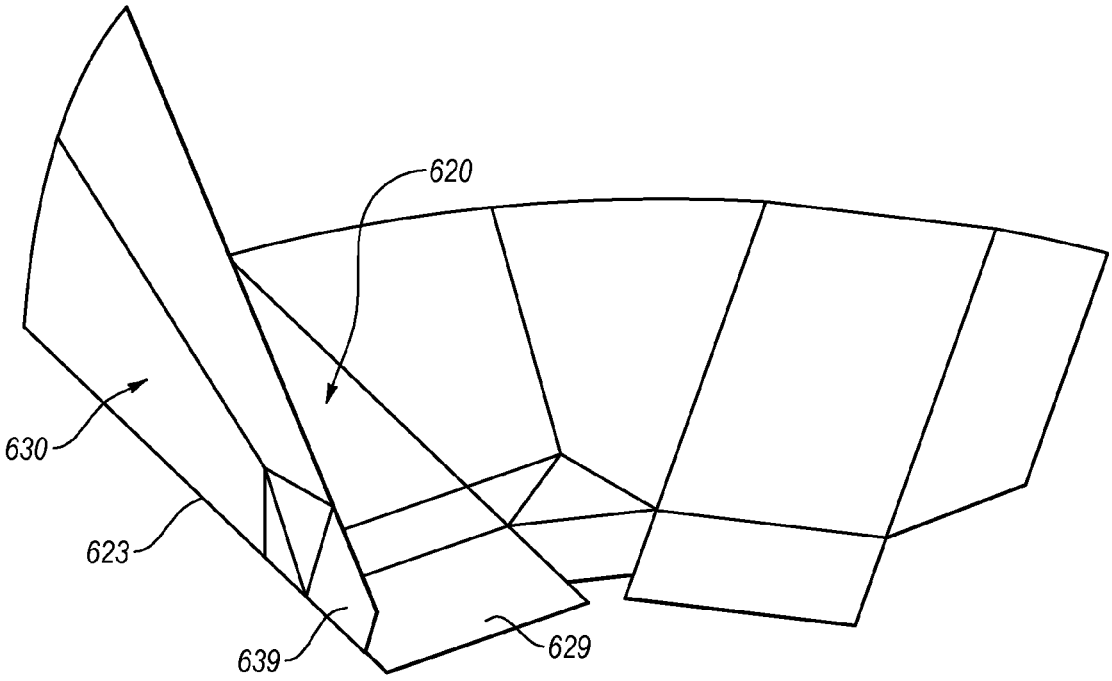
Figure 6C:
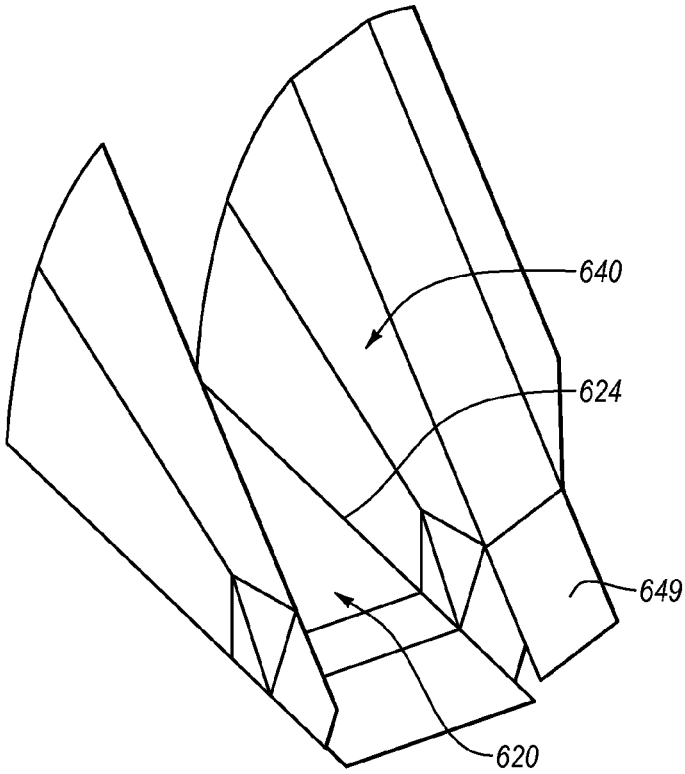

As shown in FIG. 6B, a first side portion 630 is folded upward from a lower portion 620 along a fold line 623, which is described as a first side edge of lower portion 620. As shown in FIGS. 6A-I, first side portion 640 includes a rear tab 639, and lower portion 620 includes a rear tab 629. Next, as shown in FIG. 6C, a second side portion 640 is folded upward from lower portion 620 along a fold line 624, which is described as a second side edge of lower portion 620. Second side portion 640 also includes a rear tab 643.

Figure 6D:
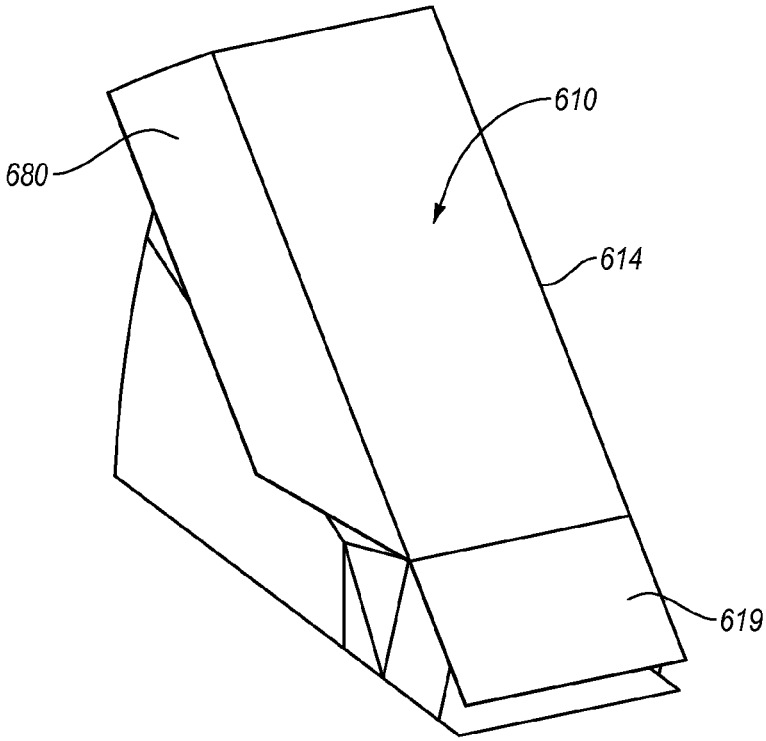

FIG. 6D shows that an upper portion 610 is then folded from second side portion 640 toward first side portion 630 along a fold line 614, which is described as a second side edge of upper portion 610. Upper portion 610 further includes a rear tab 619.

Figure 6E:
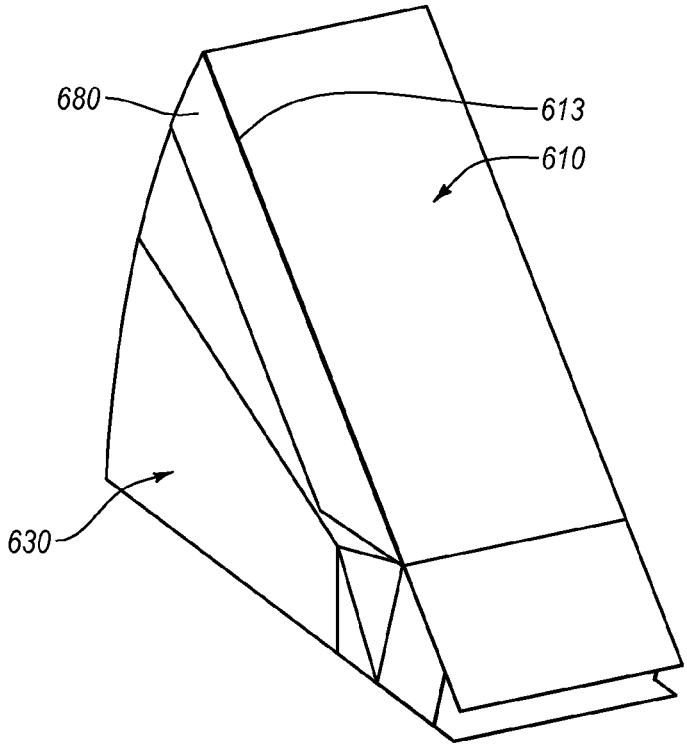

FIG. 6D also shows that a sealing tab 680 may form part of taco holder template 600. FIG. 6E shows sealing tab 680 is folded over first side portion 630 along fold line 613, which is described as a first side edge of upper portion 610. Sealing tab 680 may be useful to maintain the shape of taco holder template 600. One of skill in the art will recognize that a sealing tab, such as sealing tab 680, or multiple sealing tabs, may be placed next to upper, lower, or side portions or in any other position to facilitate the construction of a taco holder from a taco holder template.

Figure 6F:
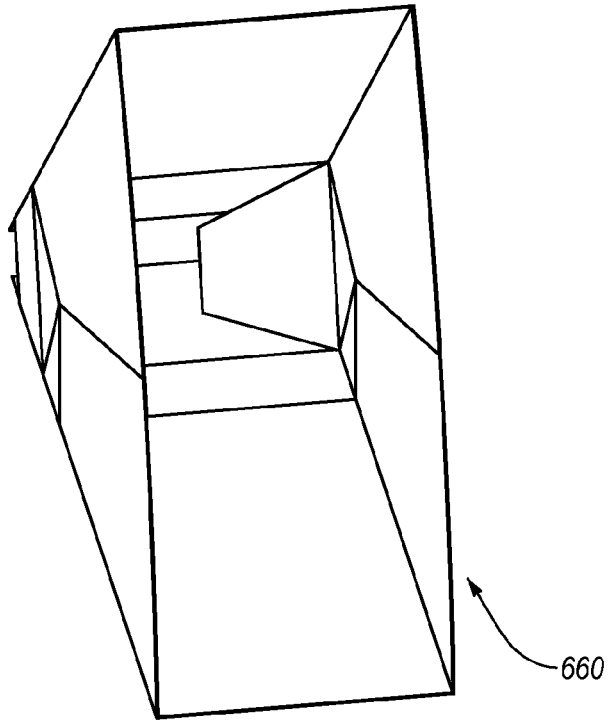

FIG. 6F is another view of the taco holder template 600 as shown in FIG. 6E. FIG. 6F shows an opening 660, which has been formed by the folding of taco holder template 600.

Figure 6G:
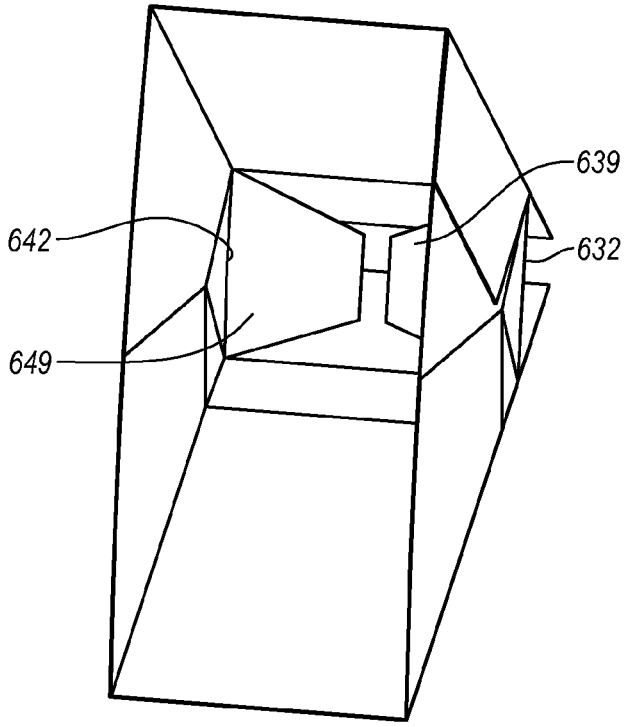

FIG. 6G shows rear tab 639 of first side portion 630 folded toward second side portion 640 along fold line 632, which is described as a rear edge of first side portion 630. FIG. 6G also shows rear tab 649 of second side portion 640 folded toward first side portion 630 along fold line 642, which is described as a rear edge of second side portion 640.

Figure 6H:
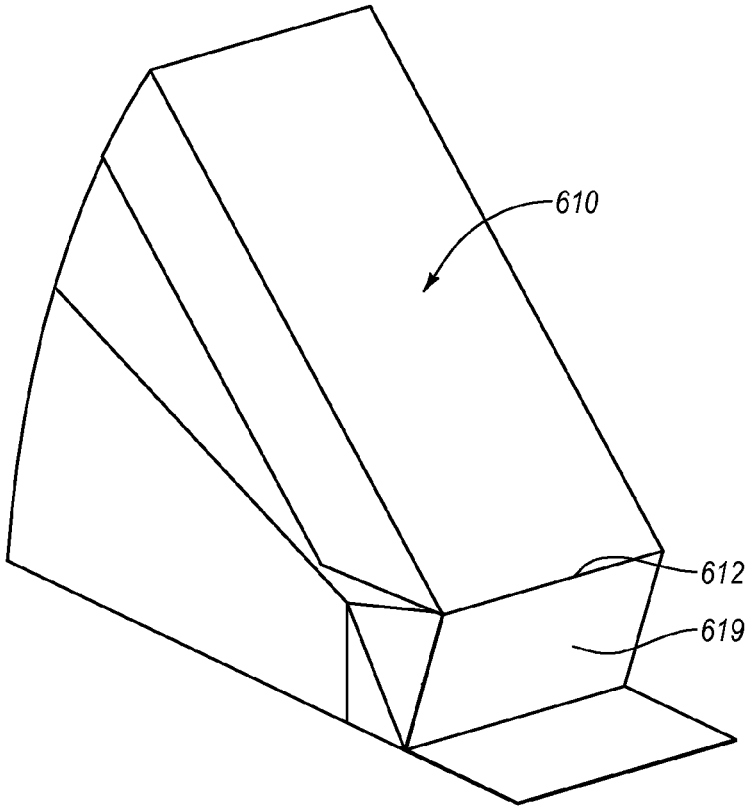
Figure 6I:
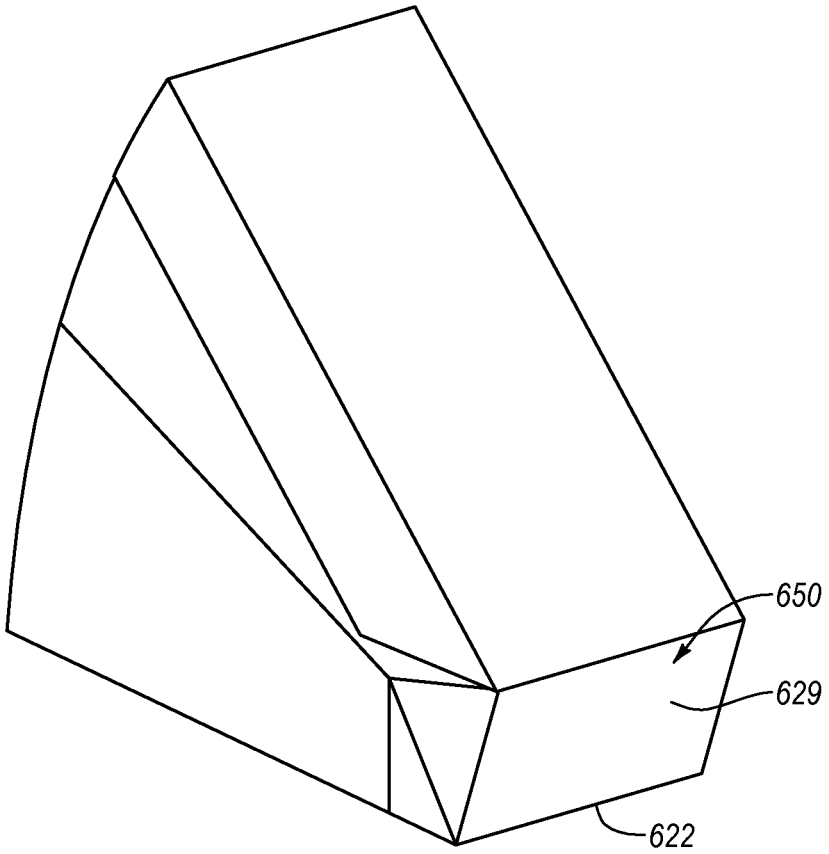
Figure 7:
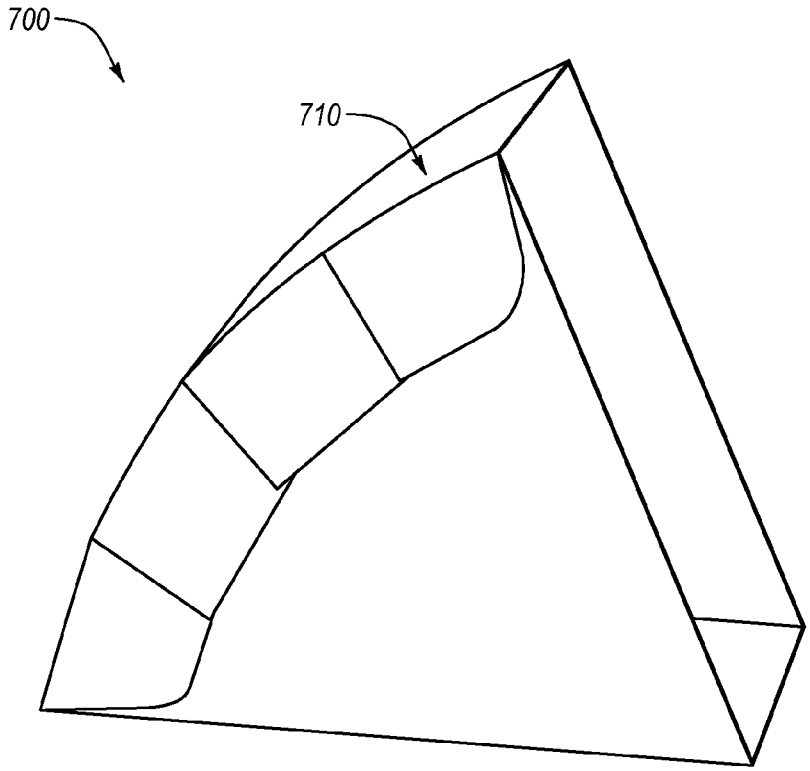
FIG. 7 illustrates another embodiment of a taco holder 700 with a curved upper portion 710, which is tailored to match the curvature of a curve of a taco shell.
Figure 8:
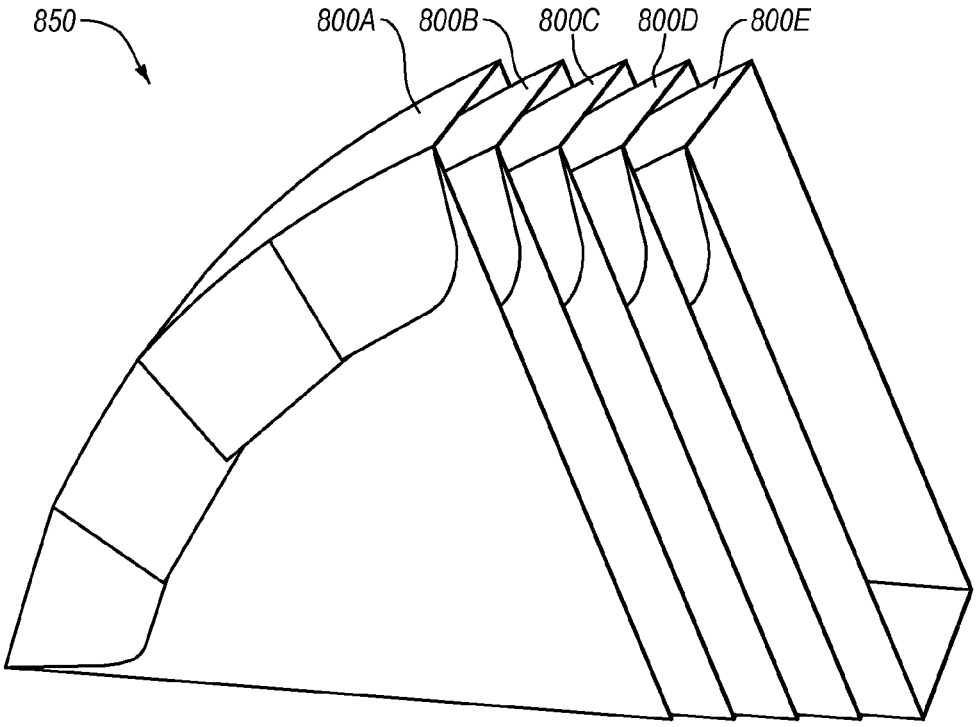
FIG. 8 illustrates a stack 850 of taco holders 800A-800E in a nested configuration.
Figure 9:
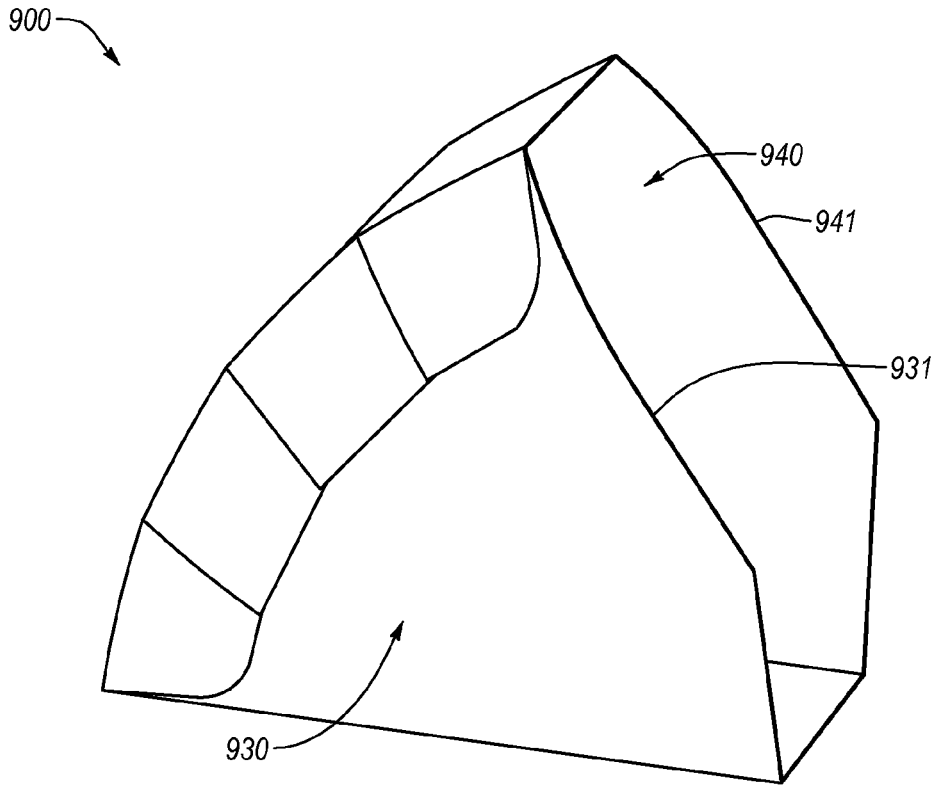
FIG. 9 illustrates another embodiment of a taco holder 900, wherein the front edge 931 of first side portion 630 and front edge 941 of second side portion 940 are skewed.
Figure 10:
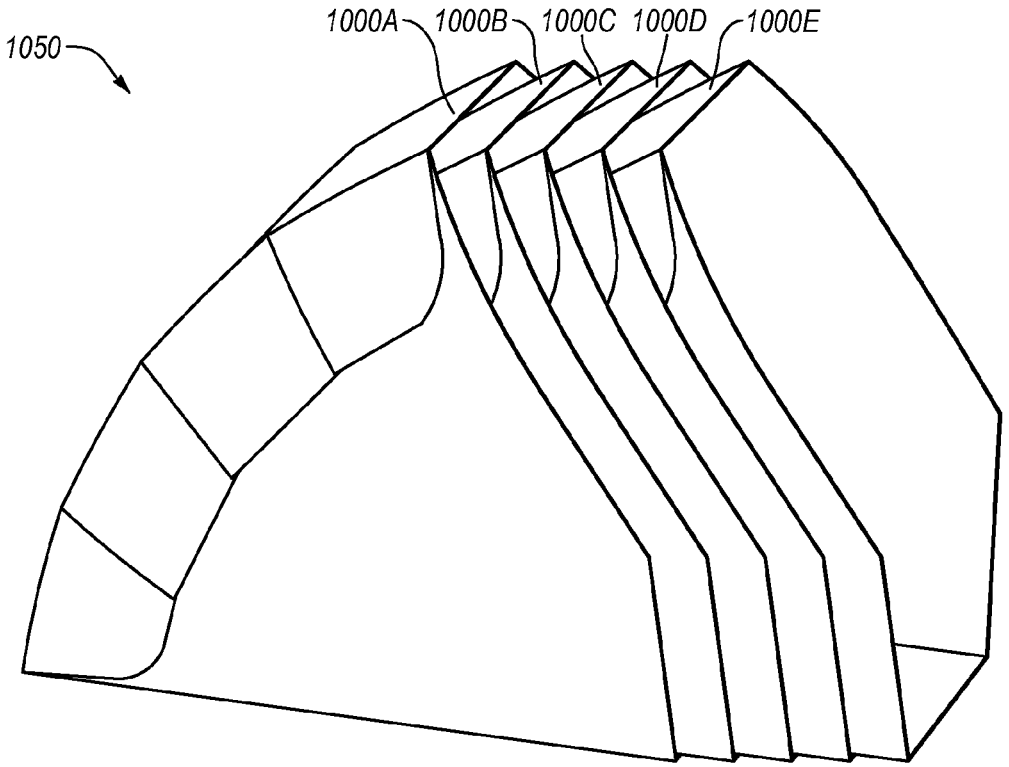
FIG. 10 illustrates a stack 1050 of taco holders 1000A-1000E in a nested configuration.

FIG. 6H shows rear tab 619 of upper portion 610 folded toward lower portion 620 along fold line 612, which is described as a rear edge of upper portion 610. FIG. 6I shows rear tab 629 folded toward upper portion 610 along fold line 622, which is described as a rear edge of lower portion 620. Thus, a rear portion 650 is formed from rear tab 629 and/or from the collection of rear tab 619 of upper portion 610, rear tab 629 of lower portion 620, rear tab 639 of first side portion 630, and rear tab 649 of second side portion 640.

The tabs described with reference to FIGS. 6A-I may be held in place by an adhesive, fasteners, or any other means of securing material together known by one of skill in the art.

Further views of the disclosed embodiments are shown in U.S. Design patent application Ser. No. 29/376,408 to David L. Millet and Gary Millet, filed Oct. 6, 2010, and entitled "TACO HOLDER," which is incorporated herein by reference in its entirety.

One of skill in the art will recognize many alternative and varied features of a taco holder. For example, a taco holder may be made of paper-based material, plastic, or other biodegradable material. The material from which a taco holder is constructed may be coated with a preservative coating, such as wax or plastic, to prevent juices or other food from soaking into and affecting the rigidity of the material. The lengths and sizes of the various portions and edges of a taco holder may be altered to conform to particular food items or to otherwise facilitate use of a taco holder.

The special language used herein, such as upper, lower, and side, should not be construed as limiting and is provided only for the convenience of the reader for reference to the various Figures.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A taco holder comprising:

a rigid, foldable template that retains a crease when folded, the taco holder having an upper portion, a lower portion, a first side portion, a second side portion, and a rear portion;

the upper portion comprising a front edge, a rear edge, a first side edge, a second side edge, and a fold line, the fold line extending between the first and second side edges of the upper portion, wherein the upper portion is coupled to the first side portion of the taco holder along the first side edge of the upper portion, wherein the upper portion is coupled to the second side portion of the taco holder along the second side edge of the upper portion, wherein the upper portion is coupled to the rear portion of the taco holder along the rear edge of the upper portion;

the lower portion comprising a front edge, a rear edge, a first side edge, and a second side edge, wherein the lower portion is coupled to the first side portion of the taco holder along the first side edge of the lower portion, wherein the lower portion is coupled to the second side portion of the taco holder along the second side edge of the lower portion, and wherein the lower portion is coupled to the rear portion of the taco holder along the rear edge of the lower portion;

the first side portion comprising a front edge, a rear edge, an upper section, a lower section, and a plurality of fold lines, wherein the first side portion is coupled to the rear portion of the taco holder along the rear edge of the first side portion, wherein at least one of the fold lines of the first side portion extends from the front edge of the first side portion toward the rear edge of the first side portion, wherein the upper section of the first side portion comprises a part of the first side portion between the upper portion of the taco holder and the at least one fold line extending from the front edge of the first side portion toward the rear edge of the first side portion, and wherein the lower section of the first side portion comprises a part of the first side portion between the lower portion of the taco holder and the at least one fold line extending from the front edge of the first side portion toward the rear edge of the first side portion;

the second side portion comprising a front edge, a rear edge, an upper section, a lower section, and a plurality of fold lines, wherein the second side portion is coupled to the rear portion of the taco holder along the rear edge of the second side portion, wherein at least one of the fold lines extends from the front edge of the second side portion toward the rear edge of the second side portion, wherein the upper section of the second side portion comprises a part of the second side portion between the upper portion of the taco holder and the at least one fold line extending from the front edge of the second side portion toward the rear edge of the second side portion, and wherein the lower section of the second side portion comprises a part of the second side portion between the lower portion of the taco holder and the at least one fold line extending from the front edge of the second side portion toward the rear edge of the second side portion; and the rear portion comprising an upper edge, a lower edge, a first side edge, and a second side edge, wherein the rear portion further comprises a plurality of stacked tabs, the plurality of tabs comprising a first tab extending from the upper edge of the rear portion, a second tab extending from the lower edge of the rear portion, a third tab extending from the first side edge of the rear portion, and a fourth tab extending from the second side edge of the rear portion, wherein at least one tab of the plurality of tabs is configured to span an area defined by the upper edge of the rear portion, the lower edge of the rear portion, the first side edge of the rear portion, and the second side edge of the rear portion, wherein taco holder is selectively configurable between an open configuration and a folded configuration, wherein the open configuration is defined by the fold line of the upper portion and the respective plurality of fold lines of the first and second side portions being substantially unfolded such that:

(1) an area between the upper portion of the taco holder, the lower portion of the taco holder, the first and second side portions of the taco holder, the rear portion of the taco holder, and the respective front edges of the upper portion, lower portion, and first and second side portions defines a receiving portion configured to receive at least a portion of a taco or other folded sandwich food; and (2) the respective front edges of the upper portion, the lower portion, the first side portion, and the second side portion define an opening configured to receive a taco or other folded sandwich food into the receiving portion, and wherein the folded configuration is defined by:

(1) the at least one fold lines extending from the front edge of the first side portion toward the rear edge of the first side portion being substantially folded in a first direction and the at least one fold line extending from the front edge of the second side portion toward the rear edge of the second side portion being substantially folded in a second direction, wherein the first direction is opposite the second direction, such that the first side portion of the taco holder is folded away from the second side portion of the taco holder such that: (a) the respective upper sections of the first and second side portions are positioned adjacent to and extend outwardly from the upper portion of the taco holder; and (b) the respective lower sections of the first and second side portions are positioned adjacent to and extend outwardly from the lower portion of the taco holder; and (2) the fold line of the upper portion being substantially folded such that the rear portion of the taco holder retains a substantially flat and unfolded configuration and is at least partially positioned over the upper portion of the taco holder such that the taco holder is in a substantially flat configuration.

2. A taco holder as recited in claim 1, wherein the fold lines extending from the respective front edges toward the respective rear edges of the first and second side portions bifurcate the first and second side portions into substantially equal upper and lower sections.

3. A taco holder as recited in claim 1, wherein the respective front edges of the first and second side portions are substantially straight.

4. A taco holder as recited in claim 1, wherein the respective first side edges, the respective second side edges, and the respective rear edges of the upper and lower portions comprise fold lines.

5. A taco holder comprising:

a rigid, foldable template that retains a crease when folded, the taco holder having an upper portion, a lower portion, a first side portion, a second side portion, a rear portion, and an upper fold line;

the upper portion comprising a front edge, a rear edge, a first side edge, and a second side edge, wherein the front edge is substantially the same length as the rear edge, wherein the first side edge and the second side edge are substantially the same length, wherein the upper portion is coupled to the first side portion of the taco holder along the first side edge of the upper portion, wherein the upper portion is coupled to the second side portion of the taco holder along the second side edge of the upper portion, and wherein the upper portion is coupled to the rear portion of the taco holder along the rear edge of the upper portion;

the lower portion comprising a front edge, a rear edge, a first side edge, and a second side edge, wherein the front edge and the rear edge are substantially the same length, wherein the first side edge and the second side edge are substantially the same length, wherein the lower portion is coupled to the first side portion of the taco holder along the first side edge of the lower portion, wherein the lower portion is coupled to the second side portion of the taco holder along the second side edge of the lower portion, and wherein the lower portion is coupled to the rear portion of the taco holder along the rear edge of the lower portion;

the first side portion comprising a front edge, a rear edge, a first rear fold line, a second rear fold line, and a bifurcating fold line, wherein the front edge is longer than the rear edge, wherein the first side portion is coupled to the rear portion of the taco holder along the rear edge of the first side portion, wherein the bifurcating fold line of the first side portion extends from the front edge of the first side portion toward the rear edge of the first side portion, wherein the bifurcating fold line of the first side portion partially bifurcates the first side portion into upper and lower sections, and wherein the first and second rear fold lines of the first side portion extend from the rear edge of the first side portion to the bifurcating fold line of the first side portion;

the second side portion comprising a front edge, a rear edge, a first rear fold line, a second rear fold line, and a bifurcating fold line, wherein the front edge is longer than the rear edge, wherein the second side portion is coupled to the rear portion of the taco holder along the rear edge of the second side portion, wherein the bifurcating fold line of the second side portion extends from the front edge of the second side portion toward the rear edge of the second side portion, wherein the bifurcating fold line of the second side portion partially bifurcates the second side portion into upper and lower sections, and wherein the first and second rear fold lines of the second side portion extend from the rear edge of the second side portion the bifurcating fold line of the second side portion;

the rear portion comprising an upper edge, a lower edge, a first side edge, and a second side edge, wherein the rear portion further comprises a plurality of stacked tabs, the plurality of tabs comprising a first tab extending from the upper edge of the rear portion, a second tab extending from the lower edge of the rear portion, a third tab extending from the first side edge of the rear portion, and a fourth tab extending from the second side edge of the rear portion, wherein at least one tab of the plurality of tabs is configured to span an area defined by the upper edge of the rear portion, the lower edge of the rear portion, the first side edge of the rear portion, and the second side edge of the rear portion; and the upper fold line extending from the bifurcating fold line of the first side portion to the bifurcating fold line of the second side portion such that the upper fold line extends across the upper portion, wherein the taco holder is selectively configurable between an open configuration and a folded configuration, wherein the open configuration is defined by: (a) the respective first rear fold lines, the respective second rear fold lines, and the respective bifurcating fold lines of the first and second side portions being substantially unfolded; and (b) the upper fold line being substantially unfolded, such that:

(1) the upper portion of the taco holder, the lower portion of the taco holder, the first and second side portions of the taco holder, the rear portion of the taco holder, and the respective front edges of the upper portion, lower portion, and first and second side portions define a receiving portion configured to receive at least a portion of a taco or other folded sandwich food; and (2) the respective front edges of the upper portion, the lower portion, the first side portion, and the second side portion define an opening configured to receive a taco or other folded sandwich food into the receiving portion, and wherein the folded configuration is defined by:

(1) the respective first rear fold lines, the respective second rear fold lines, and the respective bifurcating fold lines of the first and second side portions being substantially folded such that: (a) the bifurcating fold line of the first side portion protrudes in a first direction away from the receiving portion; and (b) the bifurcating fold line of the second side portion protrudes in a second direction away from the receiving portion, the first direction being opposite the second direction; and (2) the upper fold line being substantially folded such that the rear portion of the taco holder retains a substantially flat and unfolded configuration and is at least partially positioned over the upper portion of the taco holder such that the taco holder is in a substantially flat configuration.

6. A taco holder as recited in claim 5, wherein the template is formed from a unitary piece of material.

7. A taco holder as recited in claim 6, wherein the unitary piece of material is a sheet of paper-based material.

8. A taco holder as recited in claim 7, wherein the paper-based material is coated with a preservative coating.

* * * * *